US005110270A

United States Patent [19]

Morrick

[11] Patent Number: 5,110,270

[45] Date of Patent: May 5, 1992

[54] PERISTALTIC PUMP WITH SPRING MEANS TO URGE SLIDE MEMBERS AND ATTACHED ROLLERS RADIALLY OUTWARD ON A ROTOR

[76] Inventor: Joseph Q. Morrick, 1634 West County Rd. B, Roseville, Minn. 55113

[21] Appl. No.: 719,643

[22] Filed: Jun. 21, 1991

Related U.S. Application Data

[63] Continuation of Ser. No. 579,590, Sep. 10, 1990, abandoned, which is a continuation of Ser. No. 471,952, Jan. 29, 1990, abandoned.

[51] Int. Cl.[5] ..... F04B 43/12

[52] U.S. Cl. ..... 417/477; 604/153

[58] Field of Search ..... 417/474, 475, 476, 477; 604/153

[56] References Cited

U.S. PATENT DOCUMENTS

| | | | |
|---|---|---|---|
| 3,137,240 | 6/1964 | Hunt | 417/477 |
| 3,138,104 | 6/1964 | Cantor | 417/477 X |
| 3,963,023 | 6/1976 | Hankinson | 417/477 X |
| 4,192,863 | 7/1980 | Vadot | 417/477 |
| 4,210,138 | 7/1980 | Jess et al. | 417/477 |
| 4,256,442 | 3/1981 | Lamadrid et al. | 417/477 |
| 4,363,609 | 12/1982 | Cosentino et al. | 417/477 |
| 4,391,600 | 7/1983 | Archibald | 604/153 |
| 4,412,793 | 11/1983 | Stenberg et al. | 417/477 |
| 4,487,558 | 12/1984 | Trouther | 417/477 |
| 4,548,553 | 10/1985 | Ferster | 417/477 |
| 4,552,516 | 11/1985 | Stanley | 417/477 |
| 4,564,342 | 1/1986 | Weber et al. | 417/477 |
| 4,573,887 | 3/1986 | Smith | 417/477 |
| 4,909,713 | 3/1990 | Finsterwald et al. | 417/477 |
| 4,925,376 | 5/1990 | Kohler | 417/477 |
| 4,950,136 | 8/1990 | Haas et al. | 417/477 |

FOREIGN PATENT DOCUMENTS

| | | | |
|---|---|---|---|
| 2140872 | 2/1973 | Fed. Rep. of Germany | 417/477 |
| 0237867 | 7/1986 | Fed. Rep. of Germany | 417/477 |
| 2288238 | 5/1976 | France | 417/477 |
| 676349 | 7/1952 | United Kingdom | 417/477 |

*Primary Examiner*—Leonard E. Smith
*Attorney, Agent, or Firm*—Jacobson & Johnson

[57] ABSTRACT

A peristaltic pump has a compressible tube curved about ninety degrees around a rotor with four sets of slider arms having rollers at their outer ends extending slidably radially out from the rotor with the sliders being spring-biased outward to cause the roller to compress the tube against the pump housing when they come in contact with the tube and having linkage in the rotor between the radially extending sliders so that all of the rollers extend radially out the same distance from the rotor. A portion of the housing is hinged so that it can be swung open to provide ready access to the interior for quick and easy replacement of the compressible tube and spring-biased clamps hold the tube in place when the hinged housing section is closed and latched shut. The clamps can accommodate various sized tubing.

20 Claims, 6 Drawing Sheets

PERISTALTIC PUMP WITH SPRING MEANS TO URGE SLIDE MEMBERS AND ATTACHED ROLLERS RADIALLY OUTWARD ON A ROTOR

This application is a continuation, of application Ser. No. 07/579,590, field Sept. 10, 1990, now abandoned which is a continuation in part of application Ser. No. 07/471,952 filed Jan. 29, 1990, now abandoned.

BACKGROUND OF THE INVENTION

Peristaltic pumps are used for feeding fluids in various applications where sanitary conditions apply and where the fluid-carrying tubing has to be changed frequently. Conventionally, peristaltic pumps have a rotor surrounded by a stator or housing with a passageway between the rotor and the interior of the housing for holding a compressible tube which extends at least partially around the rotor. The rotor has radially extending compression units, usually rollers, for occluding the tube to draw fluid into one end of the tube and expel it out another end as the rotor rotates. The force applied by the compression units occludes the tube and also tends to move the tube in the direction of rotation of the rotor so the tube must be firmly secured or clamped at each end of the passageway that it rests in to prevent it from slipping. At the same time, the tube cannot be held or clamped so tight that it interferes with the flow of fluid through the tube. For various applications it has been found necessary to use different sizes (diameters) of tubes and/or tubes that have different wall thicknesses so that means for clamping the tubing in place must be adaptable to accommodate these differences. Additionally, tubes may have different degrees of compressibility or durómeters, so that the compressing rollers must be urged radially outward from the rotor with sufficient force to accommodate various degrees of tube compressibility in order to efficiently occlude different varieties of tubes that may be used in the pump. Also since the tubes are likely to be changed often for sanitary reasons, tube replacement should be easy and quick without sacrificing reliability of operation.

SUMMARY OF THE INVENTION

To hold the tubing in place, spring-loaded clamps are provided at each end of a passageway located between the housing and the rotor of a peristaltic pump. The spring loading makes the clamps adaptable to firmly hold tubing of different sizes, different wall thicknesses and different durometer or compressibility values. The upper part of the clamps are attached to a hinged part or section of the holding which can be swung open to open the clamps for easy and quick replacement of the tubing and then closed and releasably locked in place so that the clamps firmly hold the tubing in place during use.

The rotor contains radially extending pairs of sliders engaged in radially extending slots with the outer end of each set or pair of sliders holding a roller for contacting the tubing and compressing or occluding it against the interior of the housing wall when in contact with the tubing as the rotor rotates. Spring means are provided on the rotor for urging the sliders radially outward to provide the force for the roller to compress and occlude the tube. The length of tubing which partially curves around the rotor in the passageway along with the number of radially extending compressing rollers is chosen so that at least one roller is in compressing contact with the tube at all times thereby preventing any reverse or backflow through the tube. Preferably the tube covers about a ninety degree arc around the rotor and there are four radially extending rollers mounted on the rotor sliders which are spaced apart by ninety degrees with respect to the rotor axis.

In a peristaltic pump the tube-occluding elements, such as rollers, extend radially outward from the rotor and successively make contact with the tubing as the rotor rotates. Oftentimes the occluding rollers are spring-biased radially outward to apply the occluding force to the tubing. The rollers not in contact with the tubing generally are biased further radially outward than the rollers which are in occluding contact with the tubing. Similarly where the tubing is thickwalled rather than thinwalled. In those cases, as each roller makes contact with the tubing it is moved radially inward. With the normal speed of operation of the rotor this can create vibration which produces a bothersome noise and may also damage the rotor and place undue stress on the roller mechanisms. To overcome these problems, the present invention provides means on the rotor which links together the roller mechanisms so that all of the rollers extend radially outward the same distance as controlled by the roller that is in compressing contact with the tubing.

DESCRIPTION OF THE PREFERRED EMBODIMENT

Figure 1:
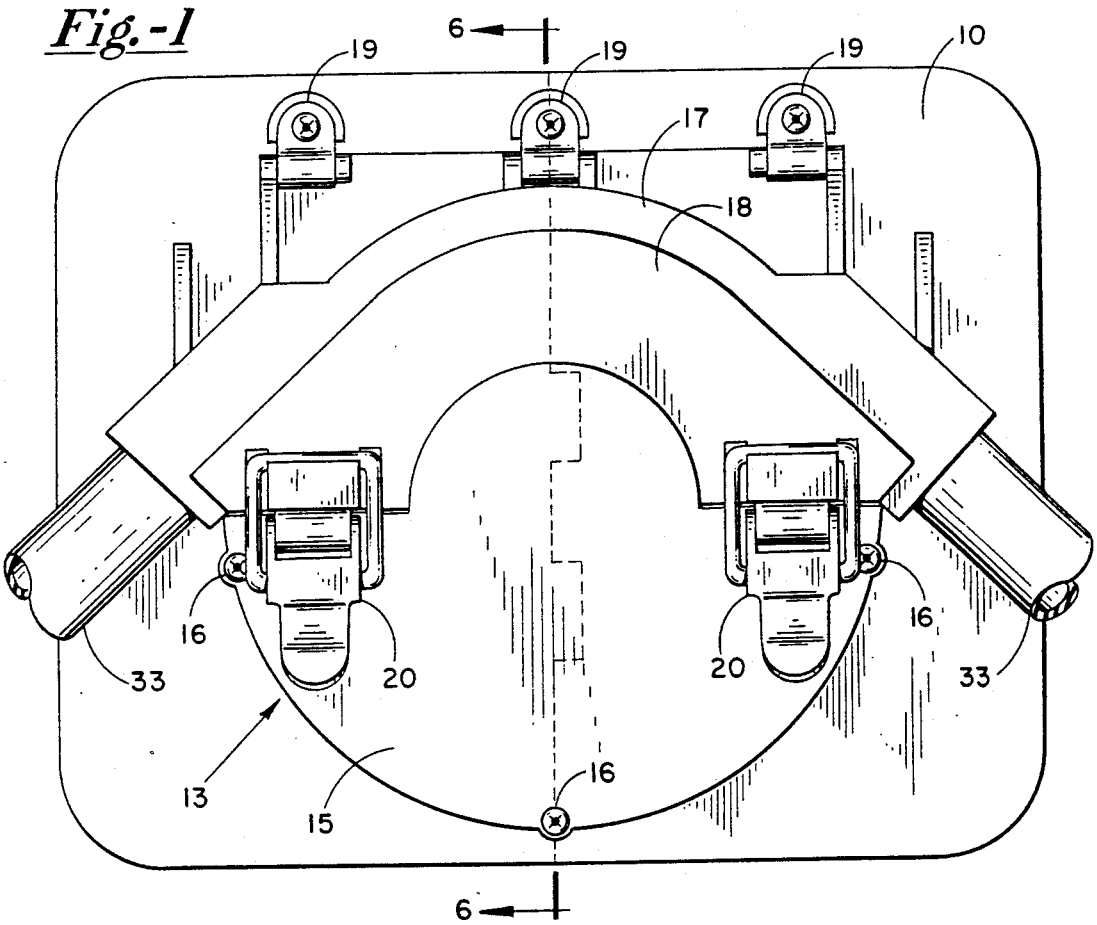
FIG. 1 is a top view of an assembled closed peristaltic pump constructed according to the teachings of this invention.
Figure 2:
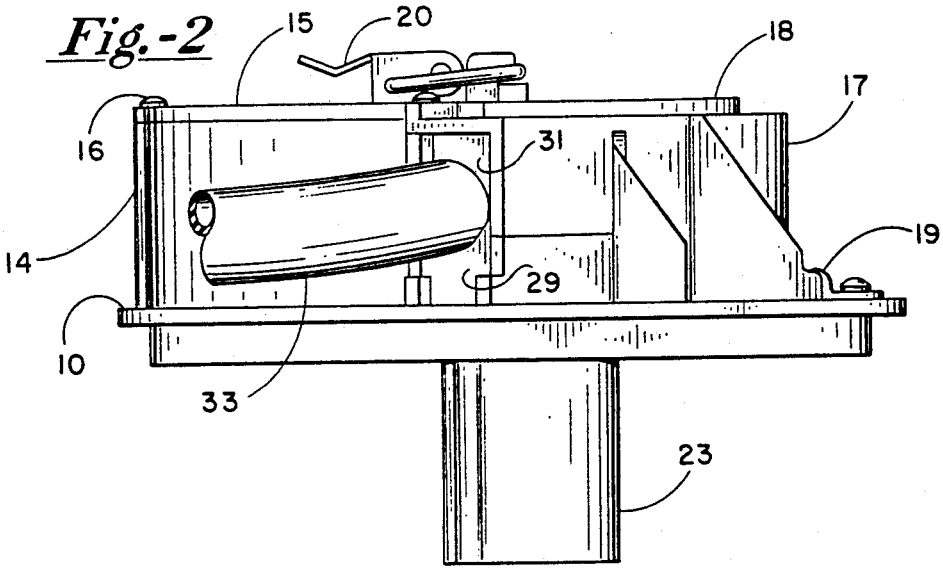
FIG. 2 is a side view of the peristaltic pump shown in FIG. 1.
Figure 5:
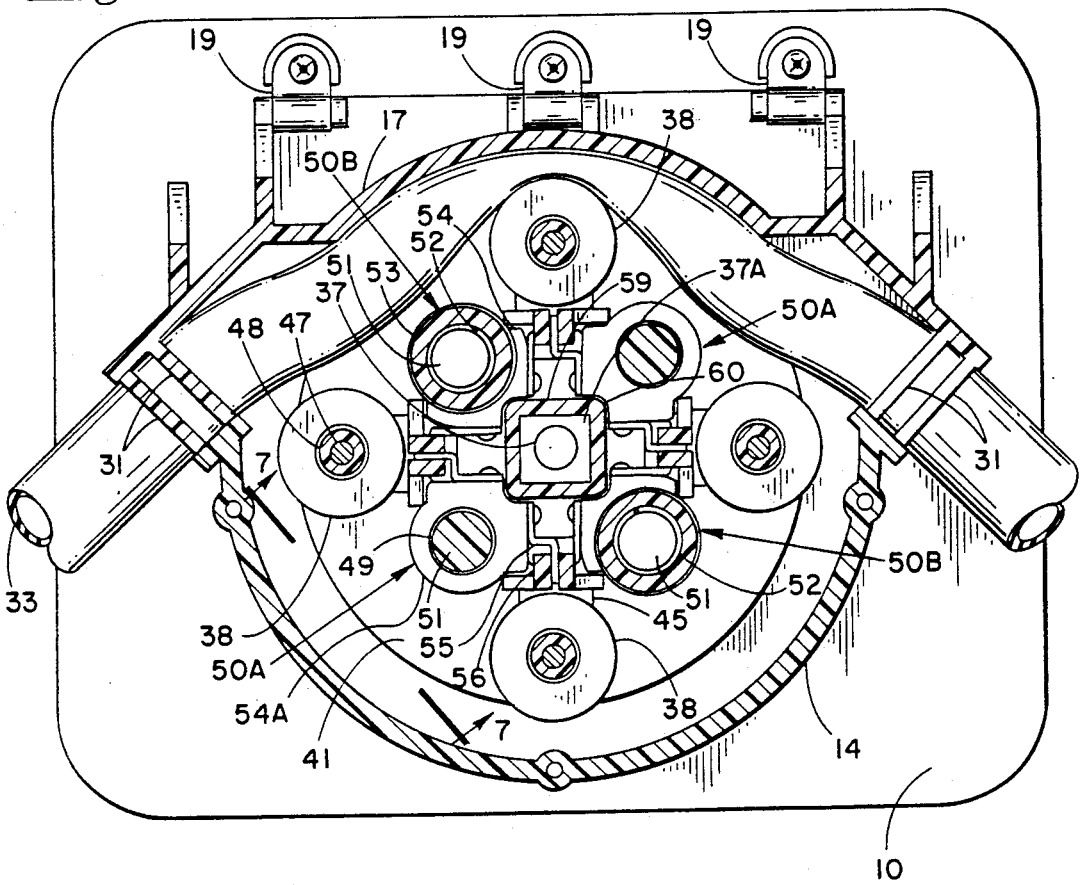
FIG. 5 is a top view with the cover removed and partially sectioned to illustrate the arrangement of the various elements of the pump rotor in a first embodiment of the invention, with some detail omitted for clarity.
Figure 6:
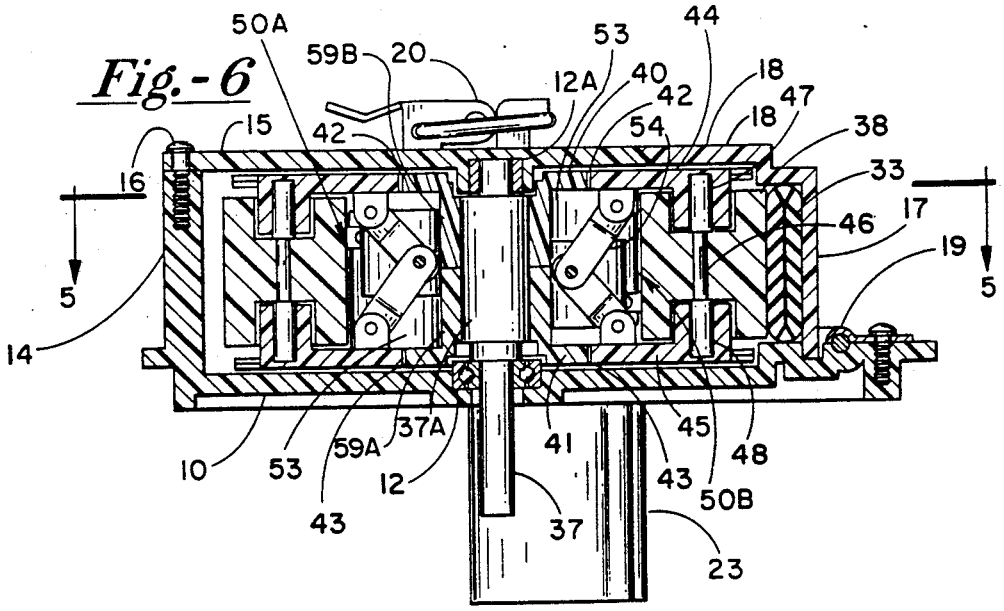
FIG. 6 is a view along section line 6—6 of FIG. 1 illustrating how the various elements in the rotor are interlinked in the first embodiment of the invention.

A peristaltic pump constructed according to the teachings of this invention, has a flat base member 10, a rotor 11 having a central shaft 37 rotatably journaled at 12 to the center of base 10 and at 12A to a cover 15 (FIG. 6). An outer housing, generally designated by reference numeral 13, generally surrounds rotor 11. Housing 13 has a first wall section 14 fixedly attached at its bottom edge to base 10 enclosing about half of rotor 11 with cover 15 attached to the top edge of wall section 14 by screws 16 and a second curved wall section 17 generally enclosing the remaining half of rototr 11 and having a cover 18 attached to its top edge. Wall or housing section 17 is hingedly attached at 19 to base member 10 so that it can be swung open and closed. When hinged housing section 17 is closed, as illustrated in FIGS. 1, 2 and 5, it is securely locked closed by a pair of conventional manually releasable draw latches 20 attached top covers 15 and 18. The latches 20 can be manually disengaged to permit wall section 17 to be swung open.

Figure 3:
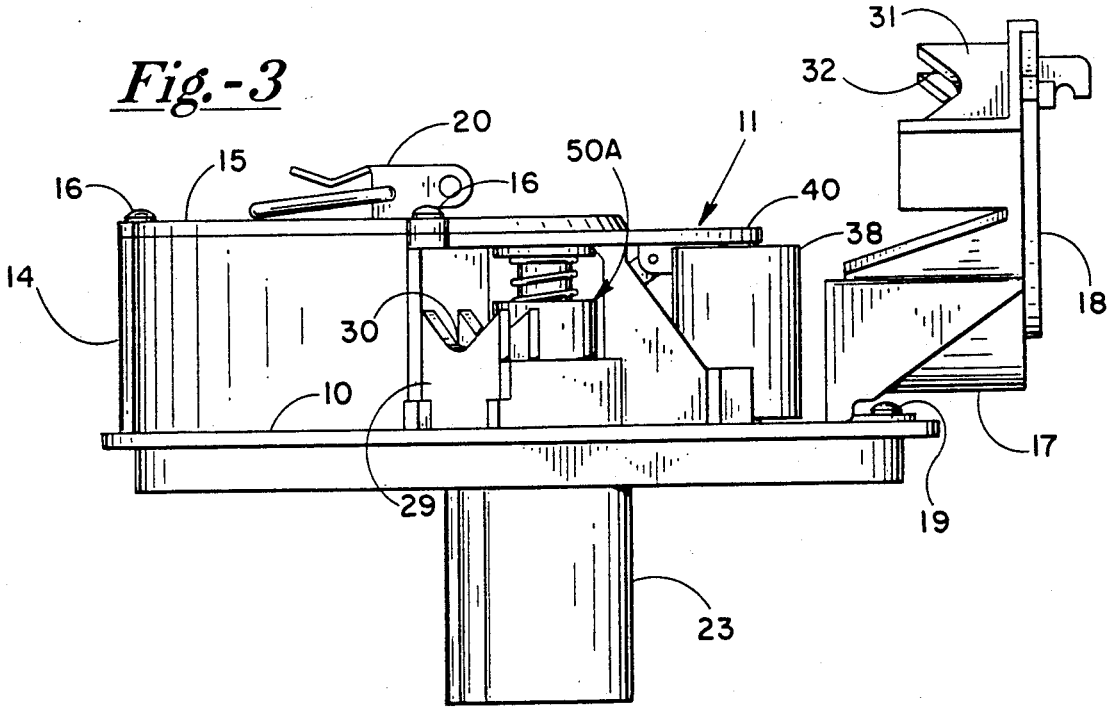
FIG. 3 is a side view with the hinged housing section swung open to show part of the interior of the pump.
Figure 4:
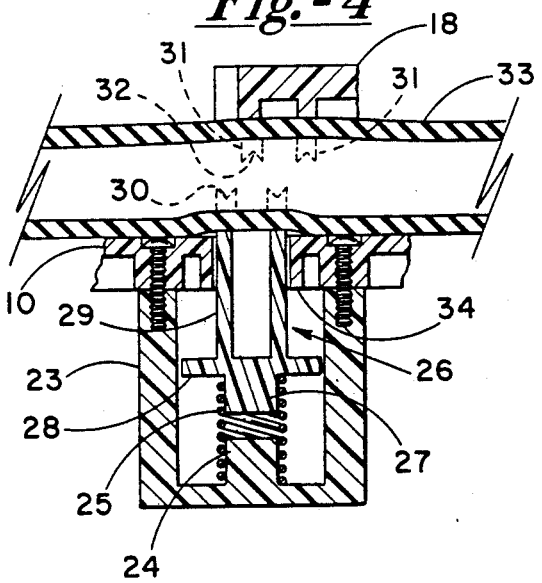
FIG. 4 is a detailed view of the clamp arrangement illustrating a tube held in place.

Attached to the underside of base member 10 opposite one another near the center of the base side edges are a pair of cylindrical hollow wells 23, only one of which is shown in the drawings. Wells 23 are located at the ends of hinged housing section 17. Extending upward from the bottom interior of well 23 at about the center is short post 24 and surrounding the post is an elongated helical spring 25 which extends above the top of post 24. A clamp member, generally designated by reference numeral 26, movably located in the interior of well 23 has a stud 27 which rests in the axial opening of spring 25 and has a flange 28 which rests against the top of spring 25. Extending upward from flange 28 are walls 29 having at their upper ends V-shaped grooves or rests 30 seen most clearly in FIG. 3. Extending inward from each end of cover 18, which is part of hinged housing section 17, are members 31 which are V-shaped at their ends 32. Only one member 31 is seen in the drawing, FIG. 3. In use, compressible resilient tubing 33 (see FIGS. 1, 2 and 4) lies in the V-shaped rests 30 of clamp member 26 at each end of the hinged housing section 17. When housing section 17 is swung closed and secured closed by draw latch 20, tubing 33 rests in the passageway between the rotor and housing section 17 and is clamped securely between the V-shaped grooves or rests 30 and 32 at the ends of the passageway by virtue of the action of helical spring 25 exerting force on member 26 forcing it against the tubing. Tubing having a diameter less than that shown in FIG. 4 would be pushed up against the V-shaped groove 32 of member 31. When hinged housing section 17 is unlatched and swung open, spring 25 forces V-clamp member 26 upward but its upward travel if limited by flange 28 striking stop 34. The section of tube 33 between the two V-shaped clamps is held in an area or passageway between the rotor and the interior curved wall of hinged housing section 17 when it is swung closed. In use, with tubing 33 held in place in this fashion, rotor shaft 37 which extends through base member 10 is rotatably driven by a motor, not shown, in conventional fashion to cause the rotor to rotate clockwise or counterclockwise within the housing. A group or series of rollers 38 which are attached to and are a part of rotor 11 extend radially outward and successively come in contact with tubing 33 as the rotor rotates to compress the tubing against the interior surface of the curved wall of housing section 17 to occlude the tubing and thereby pump fluid in one end of the tubing and out the other end in a conventional fashion. To remove and replace the tubing, which usually has to be done often in applications where it is important to maintain sterilized and/or sanitized conditions, draw latch 20 is unlatched, housing section 17 is swung open and the old tubing lifted off rests 30 and new tubing put in its place before reclosing the housing.

Preferably, the peristaltic pump of the present invention utilizes four, radially-extending, spring-biased rollers as the occluding elements, equally sopaced (ninety degrees) around the rotor. As will be explained in detail, the rollers are carried by radially movable sliders on the rotor and the spring bias is provided by spring forces applied parallel to the rotor axis. Means are provided to translate or transform the radial motion or movement of the roller to the axial motion or force of the spring. Further means are provided to link together all of the roller-carrying sliders so that all of the rollers are at the same radial distance as the roller that is in occluding contact with the tubing.

Rotor 11 has a pair of parallel, axially-spaced, coaxial upper and lower circular plates or disks 40 and 41, respectively. Shaft 37 has an expanded portion 37A which is rectangular in horizontal cross-section. Extending between disks 40 and 41 at their centers is a hollow pillar 59, also rectangular in horizontal cross-section, in which shaft section 37A is snug or press-fitted. Pillar 59 is split horizontally into two lengths, 59A and 59B, with the two ends butting up against one another, which holds disks 40 and 41 apart at the desired distance. For each of the four equally angular disposed rollers 38 shown in the prederred embodiment illustrated in the drawing, circular plate members 40 and 41 have a corresponding pair or set of upper and lower radial slots 42 and 43 with respectively corresponding flat arm or slider member 44 and 45 slidably engaged therein. Each roller 38, which is H-shaped in vertical cross-section, is press fitted onto a bushing 46 around stepped roller shaft 47 which has its larger diameter ends pressed into hubs 48 on sliders 44 and 45. In this fashion rollers 38 are to free to rotate about their respective shafts 47 and can be moved radially with respect to rotor 11 by their associated pair of sliders 44 and 45. Under the influence of spring means located on the rotor, to be described later in detail, rollers 38 are urged radially outward to make contact with and occlude tubing 33 in the passageway area between the rotor and the interior of the curved wall of hinged housing section 17 when section 17 is in the closed position. FIGS. 5 and 6 illustrate tubing 33 being occluded in this fashion.

As mentioned earlier, one of the features of this invention is the providing of linkages on the rotor among the slider mounted rollers so that all of the rollers extend radially outward the same distance from the center of the rotor as determined by the roller which is in contact with and occluding the rubber tubing. This eliminates the troublesome vibration which otherwise would occur if the spring-loaded rollers moved independently of one another. These linkages work in conjunction with springs which are mounted between plates 40 and 41 to provide the radial occluding force to rollers 38.

In one embodiment of the invention, spring assemblies 50A and 50B are equally angularly spaced around rotor 11 equidistant between each of the slider mounted rollers 38. Spring assemblies 50A are structurally and fuunctionally identical to spring assemblies 50B. They differ in that assemblies 50A are linked to upper slides 44 and assemblies 50B are linked to lower slides 45, as will be described later.

Figure 7:
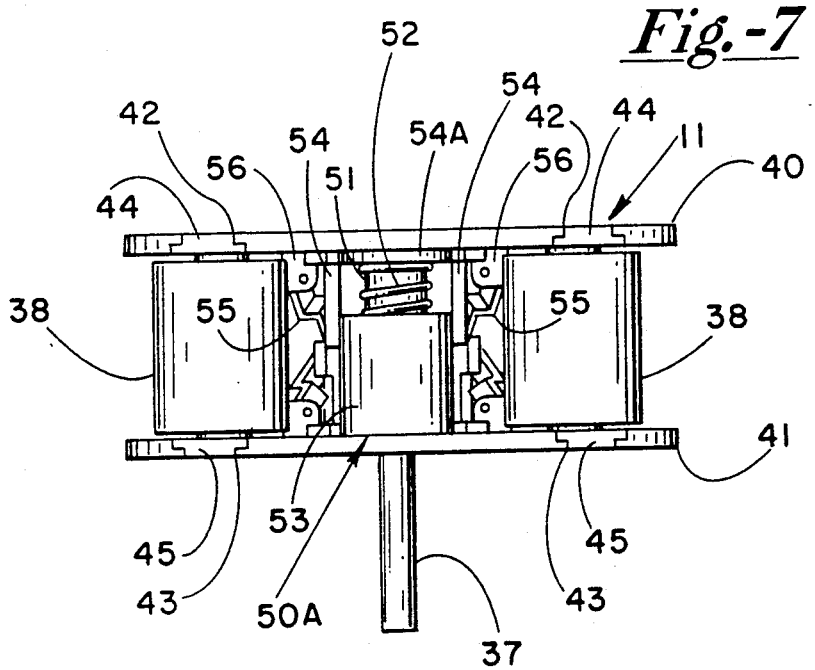
FIG. 7 is a view illustrating details of a rotor mounted spring assembly as seen along viewing line 7—7 in FIG. 5.

The construction and operation of spring assembly 50A can best be seen with reference to FIGS. 5, 6 and 7. Fixedly attached to and extending downward from upper circular plate 40 is a post or stud 51 with an elongated helical spring 52 wrapped around it. Coaxial with post 51 mounted on lower circular plate member 41 is a hollow cylindrical sleeve 53 and helical spring 52 extends down into the interior of sleeve 53 so that one end rests against circular plate 41 or the bottom of sleeve 53. Mounted coaxially with sleeve 53 and post 51 is a semi-cylindrical cup member 54 whose inner diameter is slightly larger than the outer diameter of sleeve 53 so that it can slide over yet stay aligned with sleeve 53. The closed end, 54A, of cup member 54, has a central circular aperture or opening 49 having a diameter just slightly larger than the diameter of post or stud 51 so it is free to slide parallel to the rotor axis along post 51 yet stay aligned therewith. The upper end of spring 52 rests against the interior of the closed end 54A of cup member 54. Cup member 54 moves in a direction parallel to the axis of rotor 11 as spring 52 expands and compresses in this same direction.

The spring force operating in a direction parallel to the axis of rotor 11 is translated or transformed to a radial force acting on roller 38 by suitable linkage between cup member 54 and slider member 44. A jogged lever arm 55 is pivotably attached at one end to the outside of cup member 54 and has its other end pivotably attached to the underside of a slider member 44 at ear 56. Slider member 44 is slidably engaged in slot 42 of upper circular plate member 40 and is associated with roller 38 on the right hand side of FIG. 7. Another identical jogged lever arm 55 is similarly pivotably attached at one end to the other side of cup member 54 and at its other end is pivotably attached to ear 56 jutting down from another slider member 44 which is also slidably engaged in a slot 42 in upper circular plate member 40 and is thereby associated with roller 38 on the left hand side of FIG. 7. In the FIG. 7 illustration helical spring 52 is in compression and applies an upward force against the bottom 54A of cup 54 to hold cup 54 in its furthest upper position. The linkage through jogged lever arms 55 to both adjacent upper slider members associated with rollers 38 on each side of spring assembly 50A applies a force to position slider members 44 and their associated rollers 38 to their furthest radially outward position from the center of rotor 11. When a force is applied radially inward against either of the rollers 38, for example when the right hand roller in FIG. 7 comes in contact with the tubing to occlude the tubing, the roller and its associated slider member are moved radially inward. Lever arm 55 then applies a force to the linked associated cup member 54 forcing it downward to further compress spring 52. This downward motion of cup member 54 is transferred via the other linked lever arm 55 to the slider member associated with the adjacent left side roller 38 thereby pulling the slider member and its associated roller radially inward. Corresponding linkage between the other spring assemblies 50A and 50B and their associated rollers on the rotor results in all of the rollers being held at the same radial distance.

As mentioned earlier, spring assemblies 50A and 50B are structurally and functionally identical except for one difference. This difference is that the mounting of the various elements of the spring assemblies are reversed with respect to the upper and lower circular plates 40 and 41. In other words, in spring assemblies 50B the post member 51 is attached to and extends upward from the lower circular plate member 41 and its associated coaxially mounted sleeve member 53 is attached to and extends downward from the upper circular plate member 40 and correspondingly the cup member 54 is similarly reversely mounted. Correspondingly jogged lever arms 55 are pivotably connected at each end to cup members 54 of spring assemblies 50B and pivotably attached to the slider members associated with the adjacent rollers 38 which are engaged in radial slots in the lower circular plate member 41. In other words, the spring assemblies 50A and 50B are symmetrically angularly spaced between the rollers on the rotor and are linked alternatively by the jogged lever arms 55 to slider members respectively engaged in the top and bottom circular plates 40 and 41. This reverse or inverse arrangement is provided to link together all of the rollers and the associated spring assemblies so that even though only one roller is in contact with the tubing, the other three rollers will be moved to the same radial position.

Figure 8:
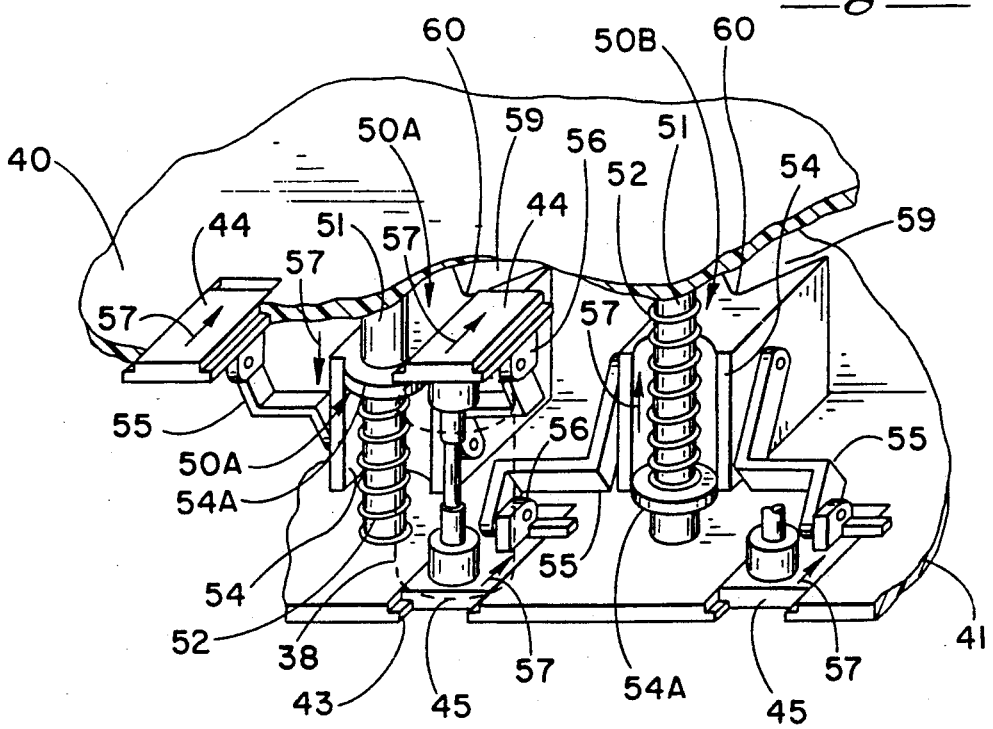
FIG. 8 is a somewhat simplified imaginary schematic illustration showing the functional interlinking of the rotor elements in the first embodiment of the invention.

FIG. 8 is an imaginary perspective view of a portion of the rotor of the first embodiment of the invention as it would appear if projected onto a flat vertical plane. Some of the component parts have been broken away and others deleted for clarity. FIG. 8 is intended as a diagrammatic illustration of the interlinking of all of the rollers via the spring assemblies. It is not intended to show accurately the component parts or their positions. It is intended only to aid in describing and understanding the interlinking of the rotor components in the first embodiment. Going from left to right in FIG. 8, upper slide member 44 is attached via jogged arm 55 to cup 54 of spring assembly 50A. The closed end 54A of cup 54 rests against the top of spring 52. On its other side cup 54 is attached to upper slide member 44 of the next adjacent roller 38, shown in phantom line for clarity. Continuing on, lower slide member 45 is linked through a jogged arm 55 to cup 54 of spring assembly 50B which has its closed end resting against the bottom of spring 52. Still continuing further, on its other side cup 54 is linked to the lower slide member 45 of the next adjacent roller via jogged arm 55. The next spring assembly would be 50A and its cup member would be linked to an upper slide member by a jogged arm. This same pattern of alternate upper and lower links between sliders and spring assembly cup members continues around the rotor to thereby interlock or interconnect all of the slide mounted rollers and the spring assemblies 50A and 50B. It can be observed then that equally spaced between each of the slide mounted rollers 38 is a spring assembly, 50A or 50B, and alternate spring assemblies are linked to upper and lower slide members by jogged arms 55. Again referring to FIG. 8, if the leftmost roller (not shown) carried by the leftmost slide 44 is pushed radially inward, for example by making occluding contact with the rubber tubing, the linkage through jogged arm 55 to cup 54 of the right adjacent spring assembly 50A causes cup member 54 to move downward from upper rotor plate 40 against spring 52. This downward motion of cup 54 is transferred to the next right upper slide 44 to draw it and its associated roller 38 inward so that it will be at the same radial position as the roller which is in occluding contact with the rubber tubing. Continuing on, the lower slide 45 is then linked to the next right adjacent spring assembly 50B by jogged arm 55 pivotably attached to cup member 54 so is pulled inward and the inward sliding action of the lower slide member 45 causes cup member 54 of the right adjacent spring assembly 50B to move upward against the force of spring 52. This upward motion of cup member 54 by virtue of the linkage through jogged arm 55 causes the next right lower slide 45 to also draw inward to bring its associated roller to the same radial position. FIG. 8 can be correlated to FIG. 5 starting with the leftmost roller 38 and moving counterclockwise therefrom. Arrows 57 in FIG. 8 designate the directions of travel of the respective slide members 44 and 45 and the cups 54 for the stated condition.

As mentioned earlier, surrounding shaft 37 and attached at each end to upper and lower plates 40 and 41, not shown in FIG. 8, is a split pillar 59 which is rectangular in cross-section. At the rear outer side of each cup 54 is an elongated groove 60 which mates with a corner of pillar 59 to provide guidance and support for the up and down movement of cups 54 parallel to the rotor axis. The linkage between sliders 44 and 45 and cups 54 through jogged arms 55 applies the forces to these respective elements necessary to move them linearly as described, but at the same time applies a skewing force component. The constraints provided by slots 42 and 43 in plate members 40 and 41 in which the sliders are engaged and the slidable engagement between the cup members 54 and pillar 59, as described above, prevents the respective elements from moving out of their straight line travel. In addition, posts 51 and sleeves 53, with which cup members 54 are slidably engaged, also keep cups 54 from veering out of their straight line of travel.

Figure 9:
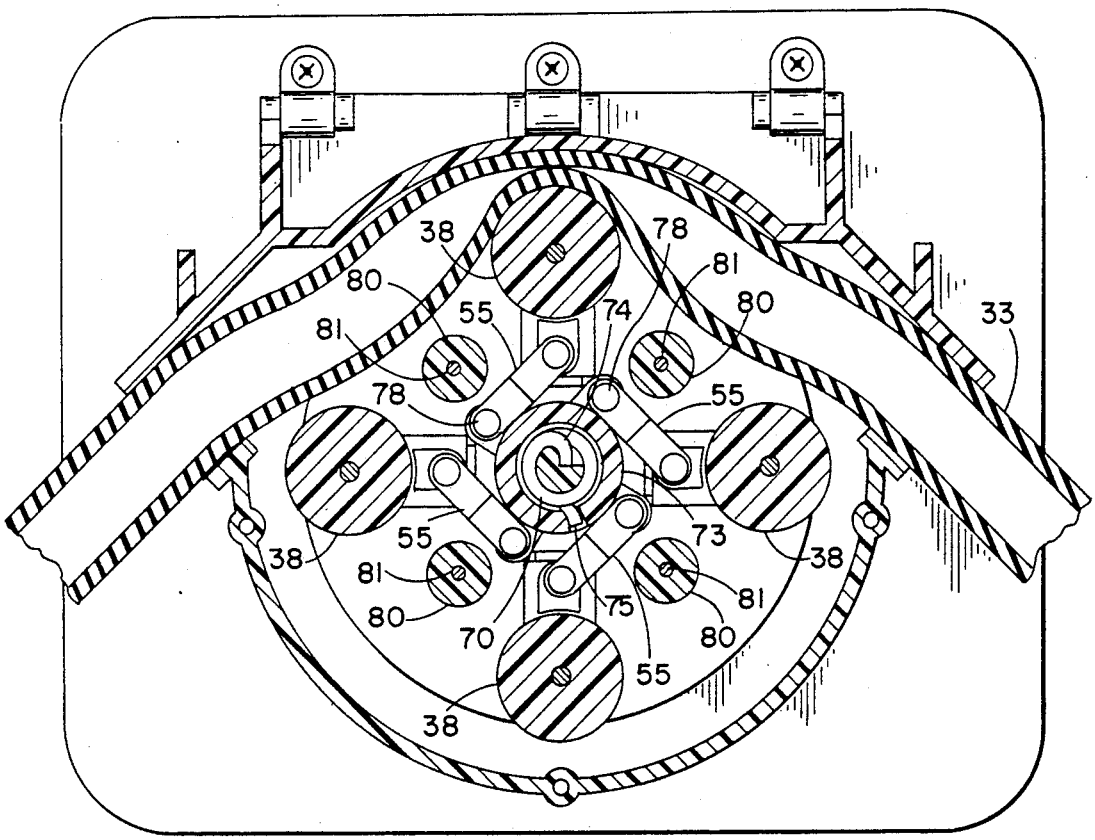
FIG. 9 is a a sectional view illustrating an alternate embodiment of the invention.
Figure 10:
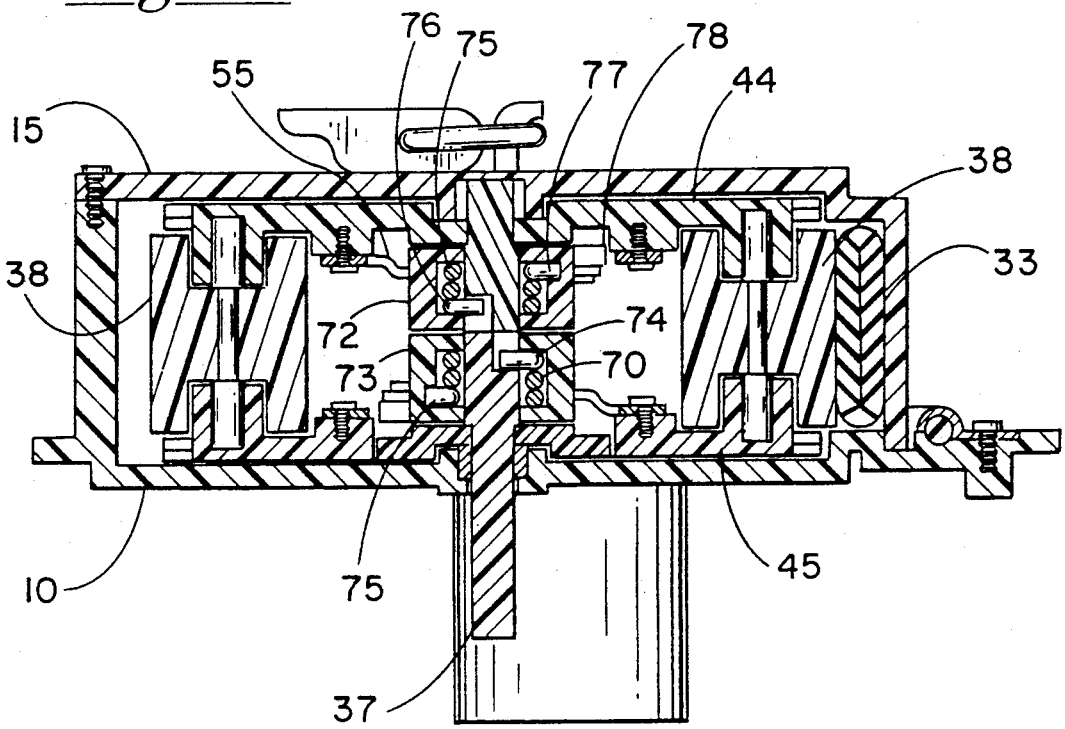
FIG. 10 is a view of the alternate embodiment similar to FIG. 6 with some elements deleted for clarity.
Figure 11:
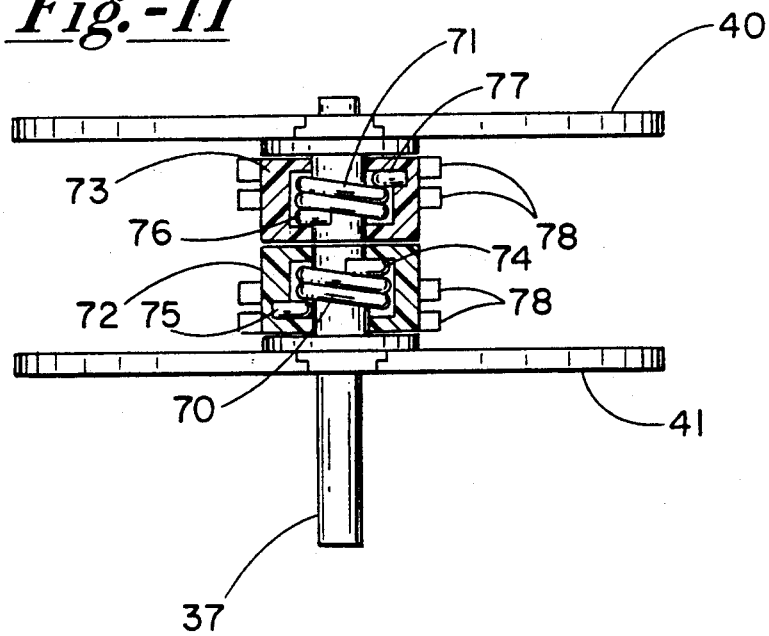
FIG. 11 is a sectional view showing the rotor spring arrangement in the second embodiment of the invention.

FIGS. 9, 10 and 11 illustrate an alternate embodiment for linking the rollers together so that radial movement of any one roller will cause a corresponding radial movement in all of the other rollers to eliminate or minimize vibration which creates noise and may cause damage to the pump. Parts or components of the second embodiment which are similar to parts or components of the first embodiments are identified by the same reference numerals. Wrapped around shaft 37 are a pair of separate but identical lower and upper helical torsion springs 70 and 71. Surrounding each of springs 70 and 71, respectively, are hollow cylindrical drums 72 and 73 whose coaxial bore is large enough to allow them to rotate about the axis of the rotor. One end of torsion spring 70 is anchored in some suitable fashion to shaft 37 at 74 and the other end is attached in some suitable fashion to corresponding lower drum member 72 as shown at 75. Similarly, an end 76 of spring 71 is anchored to shaft 37 and the other end 77 is fixedly attached to upper drum member 73. Equally angularly spaced around each of the drum members 72 and 73 are four pairs of tabs or ears 78. A jogged lever arm 55 is pivotally attached at one end between each pair of ears or tabs 78. In other words, there are four jogged lever arms 55 pivotally attached to the four pairs of ears 78 on upper drum member 73 and correspondingly four separate jogged lever arms 55 pivotally attached at one end to each of the four pair of tabs or ears 78 which are equally angularly spaced around lower drum member 72 as illustrated in FIGS. 10 and 11. Each of the lever arms 55 which is pivotally attached at one end to the upper drum member 73 is pivotally attached at its other end to a slider member 44 which is slidably engaged in a corresponding radially extending slot 42 in the upper plate member 40 and, similarly, the jogged lever arms which are pivotally attached to the lower drum member 72 at one end are pivotally attached at their other ends to slider members 45 which are slidably engaged in radially extending slots 43 in the lower rotor plate member 41. Torsion springs 70 and 71 are normally wound or biased or contracted so that they try to rotate the associated drum members 72 and 73 in a direction which, through the linkage of the corresponding jogged lever arms 55, urges the slide members to move their associated rollers radially outward along the slots in the upper and lower plate members 40 and 41 to occlude tubing 33 in the pumping housing. The slides, and the corresponding rollers attached thereto, are linked together by virtue of the upper slides being coupled to the upper drum member 73 and the lower slides being coupled to the lower drum member 72 so that the radial movement of any set of slides, and the corresponding roller attached thereto, will result in a corresponding radial movement or positioning of all of the other slides and their associated rollers. To illustrate this, with reference to FIG. 9, assume that the tubing 33 shown in FIG. 9 is replaced with tubing having a thicker wall. In that case, the roller which is in contact with the thicker walled tubing would be moved radially inward on the rotor. Through its upper jogged lever arm 55 the associated slide member 44 would then apply a force to the upper drum member 73 causing it to rotate clockwise when observed from the same view as shown in FIG. 9. At the same time, the associated jogged lever arm attached to the slide member 45 in the lower rotor plate 41 which is linked to the lower drum member 72 would cause it to rotate in the opposite direction, i.e., counterclockwise as observed in FIG. 9. As a result, then, the rotation of upper drum member 73, through its linkage via the respective remaining jogged lever arms linked to the upper slide members in the upper rotor plate member, will pull the corresponding slide member and its associated roller radially inward and similarly the rotation of the lower drum member 72 by its linkage through the jogged lever arms 55 to the slide members in the lower rotor plate member 41 will act to draw the slide members and their corresponding rollers radially inward on the rotor so that all of the rollers will then be positioned substantially at the same radial location. Each roller then successively makes occluding contact with tubing 33 with virtually no change in radial position so that there is little or no vibration or noise.

Mounting pads 80 (FIG. 9) are attached to the top side of lower rotor plate 41 and the bottom side of upper rotor plate 40 and butt together end to end and screws inserted into the threaded central openings hold the upper and lower rotor plates together.

I claim:

1. A peristaltic pump, comprising:

a base member;

a rotor having a central axis of rotation mounted on said base member;

a housing mounted on said base member generally surrounding said rotor, said housing having a curved wall section;

a passageway between the housing curved wall section and said rotor;

a compressible fluid-carrying tube resting in said passageway;

radially movable sliders on said rotor;

a plurality of rollers, each roller attached to separate sliders and extending radially outward from said rotor for making occludable contact with said tube, said rollers spaced around said rotor so that at least one roller is in contact with said tube while said rotor rotates;

an elongated helical spring in partial compression mounted on said rotor located between every two rollers, said spring being compressible and expandable in a direction parallel to the rotor axis;

a cup member in contact with said spring for moving with said spring as it compresses and expands; and lever arms pivotably connected between said cup member and a slider of each roller on each side of said spring for translating radial movement of the slider to axially-parallel movement of the spring, the arrangement being such that expansion of the spring is translated into radially outward movement of the rollers on each side of the spring and radially inward movement of either roller is translated into compression of the spring and radially inward movement of the other roller.

2. A peristaltic pump, comprising:

a base;

a rotor rotatably mounted on said base;

an axial shaft on said rotor for rotatably driving said rotor;

parallel spaced-apart upper and lower rotor plate members attached to said rotor drive shaft;

a housing attached to said base generally surrounding said rotor;

a length of occludable hollow tubing;

a passageway between said housing and said rotor for holding said tubing;

slide member radially slidably mounted on said rotor plate members;

multiple roller means equally angularly spaced around said rotor, said roller means attached to said slide members for moving radially on said rotor to occlude said tubing in said passageway as said rotor is rotated;

spring means mounted on said rotor; and means linking said spring means to said slide members for urging said slide members and their attached roller means radially outward on said rotor for occluding said tubing in said passageway.

3. The peristaltic pump as described in claim 2 wherein a section of said housing is hingedly attached to said base for opening said passageway to remove or replace said tubing.

4. The peristaltic pump as described in claim 3 wherein said hingedly attached housing section is releasably latched to the remaining housing section.

5. The peristaltic pump as described in claim 2 wherein said spring means comprises torsion spring means wrapped around said rotor shaft, one end of said spring means attached to said rotor shaft.

6. The peristaltic pump as described in claim 5 wherein said means linking said spring means to said slide members comprises:

hollow cylindrical drum means surrounding said spring means, the other end of said spring means attached to said drum means for urging said means to rotate about about said rotor drive shaft as said torsion spring means expands and contracts; and lever arms pivotably coupling said drum means to said slide members for translating the rotational motion of said drum means into radial movement of said slide members and their corresponding rollers.

7. A peristaltic pump as described in claim 6 wherein:

said spring means comprises a pair of separate torsion springs arranged end to end surrounding the rotor drive shaft and located between the rotor plate members;

said drum means comprises a pair of separate hollow cylindrical drum members, each of said drum members rotatably surrounding a different one of said pair of torsion springs, said drum members located end-to-end between the rotor plate members;

one end of each of said springs attached to the rotor drive shaft and the other end of each of said springs attached to the surrounding drum member; and one set of lever arms coupling one of said drum members to each slide member in one of said rotor plate members and another set of lever arms coupling the other drum member to each slide member in the other rotor plate member such that radial movement of any slide member and its associated roller causes corresponding radial movement in all the other slide members and their associated rollers.

8. A peristaltic pump, comprising:

a base member;

a rotor having a central axis of rotation rotatably mounted on said base member;

a rotor drive shaft located at said axis of rotation;

parallel, spaced-apart upper and lower plate members mounted on said rotor attached to said drive shaft;

a housing generally surrounding said rotor, said housing having a first section fixedly attached to said base member and a curved wall section hinged to said base member to be swung open and closed;

an arcuate passageway between said rotor and the wall of said hinged housing section for receiving and holding a compressible fluid-carrying tube when the hinged housing section is closed;

a resilient compressible fluid-carrying tube resting in said passageway;

means at each end of said arcuate passageway for grasping said tube when said hinged housing section is closed;

a plurality of radially extending rollers mounted on said rotor for making occluding contact with said tube, said rollers equally spaced around said rotor so that at least one roller is in occluding contact with said tube when said rotor is rotated by said shaft;

corresponding radial slots in said upper and lower plate members for each of said rollers;

a slider member slidably engaged in each of said radial slots, each of said rollers rotatably attached between a pair of slider members engaged in corresponding slots, said rollers attached near the radially outward ends of said slider members;

spring means mounted on said rotor; and means copupling said rotor mounted spring means to said slider members for urging said slider members to move radially in said slots.

9. A peristaltic pump as in claim 8 wherein said means for grasping said tube, comprises:

compressible spring means resting in a well below said passageway;

a first V-shaped rest coupled to the upper end of said spring means, said tube resting in said first V-shaped rest;

a second opposite facing V-shaped rest attached to said hinged housing section;

said spring means in said well urging said first V-shaped rest against said tube to securely clamp said tube between said first and second V-shaped rests when said hinged housing section is closed.

10. The peristaltic pump as described in claim 9 further including a draw latch attached between the exterior of said first housing section and said hinged housing section for releasably securing the hinged section closed.

11. The peristaltic pump as described in claim 8 wherein said rotor mounted spring means comprises elongated, helical springs mounted longitudinally between said rotor plate members.

12. The peristaltic pump as described in claim 11 wherein said helical spring are longitudinally compressible and expandable.

13. The peristaltic pump as described in claim 11 wherein said means coupling said rotor mounted helical springs to said slider members includes arm means linked between said helical springs and all of said slider members for moving said slider members and said rollers radially such that radial movement of any one pair of slider members and its associated roller causes a corresponding radial movement of all the other pairs of slider members and their associated roller.

14. The peristaltic pump as described in claim 8 wherein said rotor mounted spring means comprised a plurality of elongated, longitudinally compressible and expandable helical springs mounted longitudinally between said rotor plate members, said springs equally angularly spaced around said rotor between said rollers and their associated slider member.

15. The peristaltic pump as described in claim 14 wherein saidn springs each surround a post member fixedly attached at one end to at least one of said plate members.

16. The peristaltic pump as described in claim 15 wherein said means coupling said rotor mounted spring means to said slider members for urging said slider members radially in said slots, comprises:

a sleeve member for each of said helical springs, said sleeve member attached at one end to one of said rotor plate members and surrounding its associated spring over part of the length of the spring;

a cup member slidably mounted around each of said post members in pressing contact with one end of the spring associated with the post member for applying a force to compress said spring or for receiving a force as said spring expands, said cup member extending partly around the spring sleeve member; and a lever arm pivotably attached at one end to said cup member and pivotably attached at its other end to an adjacent slider member for interchangably translating the expansion and compression motions of said spring to the radial movement of said adjacent slider member.

17. The peristaltic pump as described in claim 16 wherein said springs, sleeve members and cup members are symmetrically angularly spaced between said rollers with alternate sleeve members attached to opposite plate members and each cup member attached by lever arms to adjacent slider members slidably engaged in a plate member opposite the plate member that the corresponding associated sleeve member is attached to for linking together all of said rollers such that radial movement of any one roller produces a corresponding radial movement in all the other rollers.

18. A peristaltic pump, comprising:

a base;

a rotor rotatably mounted on said base;

an axial shaft on said rotor for rotatably driving said rotor;

a housing attached to said base generally surrounding said rotor;

a length of occludable hollow tubing;

a passageway between said housing and said rotor for holding said tubing;

multiple roller means equally angulary spaced around said rotor for moving radially on said rotor to occlude said tubing in said passageway as said rotor is rotated;

a hollow drum around said shaft;

expandable and contractable spring means attached between said shaft and said drum for rotating said drum about said shaft as said spring means expands and contracts; and means linking said drum to said roller means for moving said roller means radially on said rotor as said drum rotates about said shaft.

19. The peristaltic pump as described in claim 18 wherein said spring means comprises a torsion spring attached at one end to the shaft and at its other end to said drum.

20. The peristaltic pump as described in claim 18 wherein said linking means and said drum means operatively position all of said roller means the same radial distance on said rotor.

* * * * *